US009130272B2

(12) United States Patent
Fujisawa

(10) Patent No.: US 9,130,272 B2
(45) Date of Patent: Sep. 8, 2015

(54) ELECTRONIC DEVICE THAT IS WORN ON THE WRIST

(75) Inventor: Teruhiko Fujisawa, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 384 days.

(21) Appl. No.: 12/913,548

(22) Filed: Oct. 27, 2010

(65) Prior Publication Data

US 2011/0102274 A1 May 5, 2011

(30) Foreign Application Priority Data

Oct. 30, 2009 (JP) ..... 2009-250631

(51) Int. Cl.

| | |
|---|---|
| ***H01Q 1/12*** | (2006.01) |
| ***G04B 47/00*** | (2006.01) |
| ***H01Q 1/27*** | (2006.01) |
| ***G04G 5/00*** | (2013.01) |
| ***H01Q 1/40*** | (2006.01) |
| ***H01Q 7/00*** | (2006.01) |
| ***G04R 60/10*** | (2013.01) |

(52) U.S. Cl.

CPC ..... *H01Q 1/273* (2013.01); *G04G 5/002* (2013.01); *G04R 60/10* (2013.01); *H01Q 1/40* (2013.01); *H01Q 7/00* (2013.01)

(58) Field of Classification Search

CPC ..... H01Q 1/243; H01Q 9/42
USPC ..... 343/702, 718, 866; 368/47, 88
See application file for complete search history.

(56) References Cited

U.S. PATENT DOCUMENTS

| | | | | |
|---|---|---|---|---|
| 5,768,217 | A * | 6/1998 | Sonoda et al. | 368/10 |
| 5,926,144 | A * | 7/1999 | Bolanos et al. | 343/718 |
| 6,278,873 | B1 * | 8/2001 | Itakura et al. | 455/351 |
| 6,825,751 | B1 | 11/2004 | Kita et al. | |
| 6,853,605 | B2 * | 2/2005 | Fujisawa et al. | 368/10 |
| 7,151,496 | B2 * | 12/2006 | Casagrande et al. | 343/718 |
| 7,215,600 | B1 * | 5/2007 | DeRosa et al. | 368/10 |
| 7,417,596 | B2 * | 8/2008 | Zellweger et al. | 343/718 |
| 7,764,236 | B2 * | 7/2010 | Hill et al. | 343/702 |
| 7,782,261 | B2 * | 8/2010 | An et al. | 343/702 |
| 2005/0219955 | A1 | 10/2005 | Xu et al. | |
| 2006/0126438 | A1 * | 6/2006 | Itou et al. | 368/47 |
| 2008/0018547 | A1 | 1/2008 | Iwasaki | |
| 2009/0058737 | A1 * | 3/2009 | Tsujimura et al. | 343/702 |

FOREIGN PATENT DOCUMENTS

| | | |
|---|---|---|
| EP | 2 275 884 A2 | 1/2011 |
| JP | 06-501595 A | 2/1994 |
| JP | 2000-059241 | 2/2000 |

(Continued)

*Primary Examiner* — Dameon E Levi
*Assistant Examiner* — Hasan Islam

(57) ABSTRACT

A wrist-worn electronic device includes an antenna that receives externally transmitted radio signals; a case of which at least part is made of a non-conductive material; an information display unit that is housed inside the case, is flat, and is made of a non-conductive material; a back cover that is attached to the case and is made of a conductive material; and a reception unit that is positioned and housed inside the case between the information display unit and the back cover, and processes a reception signal based on radio signals received by the antenna. The antenna has an antenna electrode that is disposed and formed as a line around the outside of the information display unit. The back cover is connected to the ground potential of the reception unit and reflects the radio signals.

8 Claims, 10 Drawing Sheets

(56) References Cited

FOREIGN PATENT DOCUMENTS

| | | | |
|---|---|---|---|
| JP | 2000-286761 | A | 10/2000 |
| JP | 2003-050983 | A | 2/2003 |
| JP | 2006-013798 | | 1/2006 |
| JP | 2007-028150 | A | 2/2007 |
| JP | 2009-168656 | | 7/2009 |
| WO | 92/01953 | A1 | 2/1992 |
| WO | 2004/006028 | A1 | 1/2004 |

* cited by examiner

ELECTRONIC DEVICE THAT IS WORN ON THE WRIST

CROSS-REFERENCE TO RELATED APPLICATION(S)

The entire disclosure of Japanese Patent Application No. 2009-250631, filed Oct. 30, 2009, is expressly incorporated by reference herein.

BACKGROUND

1. Technical Field

The present invention relates to an electronic device that is worn on the wrist and has a built-in antenna for receiving radio signals that include time information and are transmitted from an external source.

2. Related Art

Electronic timepieces that have a wireless communication function have been available for some time. One use for this wireless communication function is to receive signals from a positioning information satellite, such as a GPS (Global Positioning System) satellite, and acquire the current time from the received satellite signal.

When a radio capability is rendered in a wristwatch as an example of an electronic timepiece with a radio function, an antenna that can provide satisfactory performance in a confined space is essential. See, for example, Japanese Unexamined Patent Appl. Pub. JP-A-2000-59241 and Japanese Unexamined Patent Appl. Pub. JP-A-2009-168656.

In JP-A-2000-59241, a C-shaped loop antenna with a dielectric substrate is disposed around the display unit, and the metal base of the wristwatch is used as a ground plate.

In JP-A-2009-168656, an unbalanced antenna is disposed around the perimeter of a dial located between the crystal and the movement of a wristwatch, and the dial is used as part of a ground plate.

A problem with the configurations taught in both JP-A-2000-59241 and JP-A-2000-59241 is that sufficient antenna performance cannot be assure. More particularly, the problem with the configurations taught in JP-A-2000-59241 and JP-A-2000-59241 is that the antenna and the ground plate (the metal base or the dial) are too close together, good reflection of RF signals from the ground plate is not achieved, and sufficient antenna performance cannot be obtained.

SUMMARY

An electronic device according to the present invention that is worn on the wrist can assure good reception performance.

A first aspect of the invention is a wrist-worn electronic device that includes: an antenna that receives externally transmitted radio signals; a case of which at least part is made of a non-conductive material; an information display unit that is housed inside the case, is flat, and is made of a non-conductive material; a back cover that is attached to the case and is made of a conductive material; and a reception unit that is positioned and housed inside the case between the information display unit and the back cover, and processes a reception signal based on radio signals received by the antenna; wherein the antenna has an antenna electrode that is disposed and formed as a line around the outside of the information display unit; and the back cover is connected to the ground potential of the reception unit and reflects the radio signals.

The antenna electrode may be an annular antenna electrode that is continuous in the circumferential direction, or a C-shaped antenna electrode, for example, that is not continuous in the circumferential direction and has part of the annular shape missing.

Wrist-worn as used herein is not limited to wearing on the wrist, and includes wearing the electronic device on the upper arm or any other desirable part of the arm.

In this aspect of the invention the reception unit that processes reception signals based on radio signals received by the antenna is positioned between the information display unit and the back cover, the antenna electrode line is disposed along the outside of the information display unit, and the back cover is made from a conductive material and made to function as a reflection plate that reflects the radio signals. As a result, the information display unit and back cover are separated by some distance because the reception unit is disposed therebetween. The antenna electrode disposed along the outside of the information display unit and the back cover (reflector) are therefore also separated with some distance therebetween, and the reception performance of the antenna can be improved compared with a configuration in which a dial adjacent to the antenna is used as a reflector. In addition, because the back cover functions as a reflector, change in the antenna tuning frequency can be prevented when used in a wristwatch, antenna characteristics can be improved and good reception characteristics can be achieved. More particularly, because the back cover can be easily designed with a relatively large outside dimension, signal reflection efficiency can be easily improved, and antenna characteristics can be easily improved.

In a wrist-worn electronic device according to another aspect of the invention, the back cover is preferably made with a larger outside dimension than the outside dimension of the antenna electrode.

This aspect of the invention can more efficiently reflect signals off the back cover, which is larger than the outside dimension of the antenna electrode, and thus improve the reception strength entering the antenna electrode.

In a wrist-worn electronic device according to another aspect of the invention, a dial ring is preferably disposed around the outside of the information display unit and is formed in a ring shape from a non-conductive material, a bezel that is disposed on the outside circumference side of the dial ring and is formed in a ring shape from a non-conductive material, and the antenna is disposed between and covered by the dial ring and the bezel.

In this aspect of the invention, because the antenna is disposed between a dial ring and a bezel that are ring shaped and made from a non-conductive material, good reception performance can be achieved because signals are not blocked, and impairment of the appearance can be prevented because the antenna is covered by the dial ring and bezel and is not exposed to the outside.

Further preferably in a wrist-worn electronic device according to another aspect of the invention, the antenna has an annular dielectric substrate to which the antenna electrode is disposed; and the antenna electrode is formed with a circumferential length approximately equal to one wavelength of the wavelength of the radio signal after wavelength shortening by the dielectric substrate.

An annular or ring-shaped dielectric substrate as used herein is not limited to shapes that are circumferentially continuous, such as plane circles and plane rectangles, and includes shapes that are discontinuous circumferentially with a part missing in the circumference, such as a dielectric substrate that is C-shaped in plan view.

The reception performance of the antenna can be optimized in this aspect of the invention because the circumferential length of the antenna electrode on the dielectric substrate is approximately equal to one wavelength of the signals after wavelength shortening by the dielectric substrate.

Note that a circumferential length approximately equal to one wavelength of the wavelength shortened signal is, for example, from 0.9 to 1.3 wavelength and preferably 1.1 wavelength.

Further preferably in a wrist-worn electronic device according to another aspect of the invention, the antenna has an annular dielectric substrate to which the antenna electrode is disposed; the antenna electrode has an annular main antenna unit disposed to the top of the dielectric substrate on the opposite side as the bottom side thereof facing the back cover, and a power supply unit that branches from at least one junction rendered in part of the main antenna unit and is disposed to the dielectric substrate; and the wrist-worn electronic device also has a connection member that is housed in the case, contacts the power supply unit, and transmits the reception signal to the reception unit.

An annular or ring-shaped dielectric substrate or main antenna unit as used herein is not limited to shapes that are circumferentially continuous, such as plane circles and plane rectangles, and includes shapes that are discontinuous circumferentially with a part missing in the circumference, such as a dielectric substrate or main antenna unit that is C-shaped in plan view. In addition, the dielectric substrate and main antenna unit may be rendered with both having a shape that is circumferentially continuous, both having a shape that is not circumferentially continuous, or one having a shape that is circumferentially continuous and the other having a shape that is not circumferentially continuous.

In this aspect of the invention, reception signals based on the signals received by the main antenna unit disposed on the top side of the dielectric substrate are transmitted from the power supply unit that branches from the main antenna unit through the connection member to the reception unit. As a result, reception signals extracted from the received signals can be suitably transmitted to the reception unit by means of a simple configuration such as rendering a through-hole that passes the connection member through without the connection member touching other conductive parts.

Further preferably in a wrist-worn electronic device according to another aspect of the invention, the information display unit is a dial or a display panel.

In this aspect of the invention a dial or a display panel is used as the information display unit made from a non-conductive material. A dial made from a non-conductive material may be made of any material that can assure the specified reception characteristics when the antenna electrode is disposed around the dial, and a dial made of plastic, ceramic, or other non-conductive material can be used.

A display panel made from a non-conductive material may be made of any material that can assure the specified reception characteristics when the antenna electrode is disposed around the display panel, and a display panel that is effectively a non-conductive member in terms of the reception characteristics of the antenna can be used even if some parts thereof are conductive. Examples of such devices include liquid crystal display panels, organic EL (electroluminescent) panels, and electrophoretic display panels.

If the antenna electrode is disposed around the outside of a dial or display panel made from such non-conductive materials, reception characteristics are not impaired and good reception performance can be achieved.

Other objects and attainments together with a fuller understanding of the invention will become apparent and appreciated by referring to the following description and claims taken in conjunction with the accompanying drawings.

DESCRIPTION OF EMBODIMENTS

Embodiment 1

A first embodiment of the invention is described below with reference to the accompanying figures.

Figure 1:
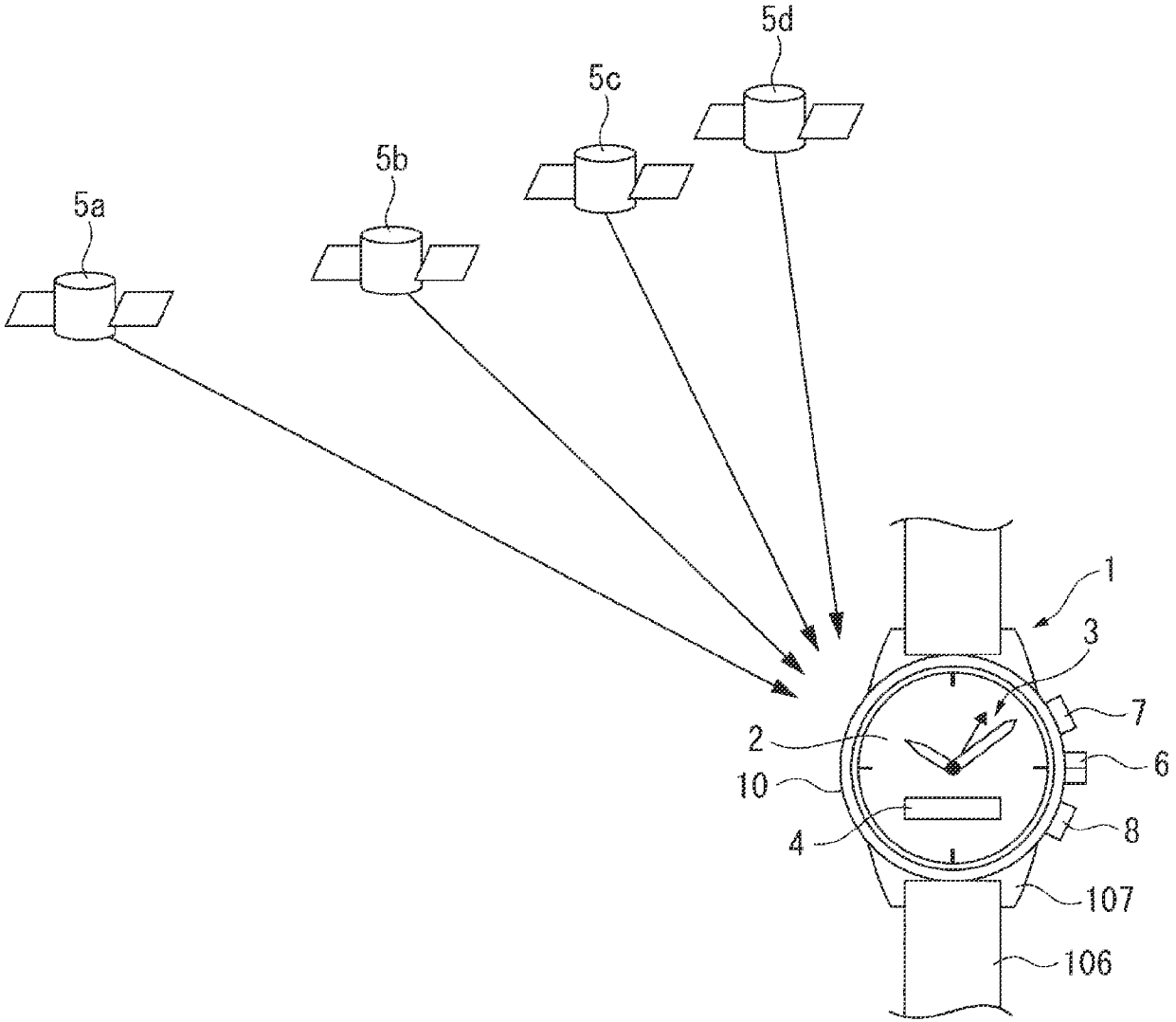
FIG. 1 schematically describes an electronic device that is a wrist-worn electronic device according to the invention.

As shown in FIG. 1, an electronic device 1 according to the first embodiment of the invention is worn on the wrist, and more specifically is an electronic timepiece that is worn on the wrist and has a time display unit for displaying time by means of a dial 2 and hands 3 as information display units.

The dial 2 is made with a disk shape from an electrically non-conductive material such as plastic or a ceramic that affords a high quality appearance. A window is formed in a part of the dial 2, and an LCD display panel or other type of display 4 is presented in this window as an information display unit.

The hands 3 include a second hand, minute hand, and hour hand, and are driven through a drive mechanism including a stepper motor and wheel train as described below. Note that because the area of the hands 3 is small, they do not interfere with radio signal reception even if made of metal, but are preferably made from a non-conductive material because interference with RF signal reception can be avoided.

The display 4 is an LCD display panel in this embodiment of the invention, and presents positioning information such as the latitude and longitude or a city name, and other types of messages and information.

The electronic device 1 is configured so that it can receive satellite signals and acquire satellite time information from a plurality of GPS satellites 5*a*, 5*b*, 5*c*, 5*d* and so forth orbiting the Earth on specific orbits, and can adjust the internally kept time based on the received time information.

Note that the GPS satellites 5*a*, 5*b*, 5*c*, 5*d* are one example of positioning information satellites in the invention, and many GPS satellites are in orbit. At present, there are approximately 30 GPS satellites 5*a*, 5*b*, 5*c*, 5*d* in orbit.

The GPS wristwatch 1 also has a crown 6 and buttons 7 and 8 for externally operating the GPS wristwatch 1.

Internal Configuration of the Electronic Device 1

The internal configuration of the electronic device 1 is described next.

Figure 2:
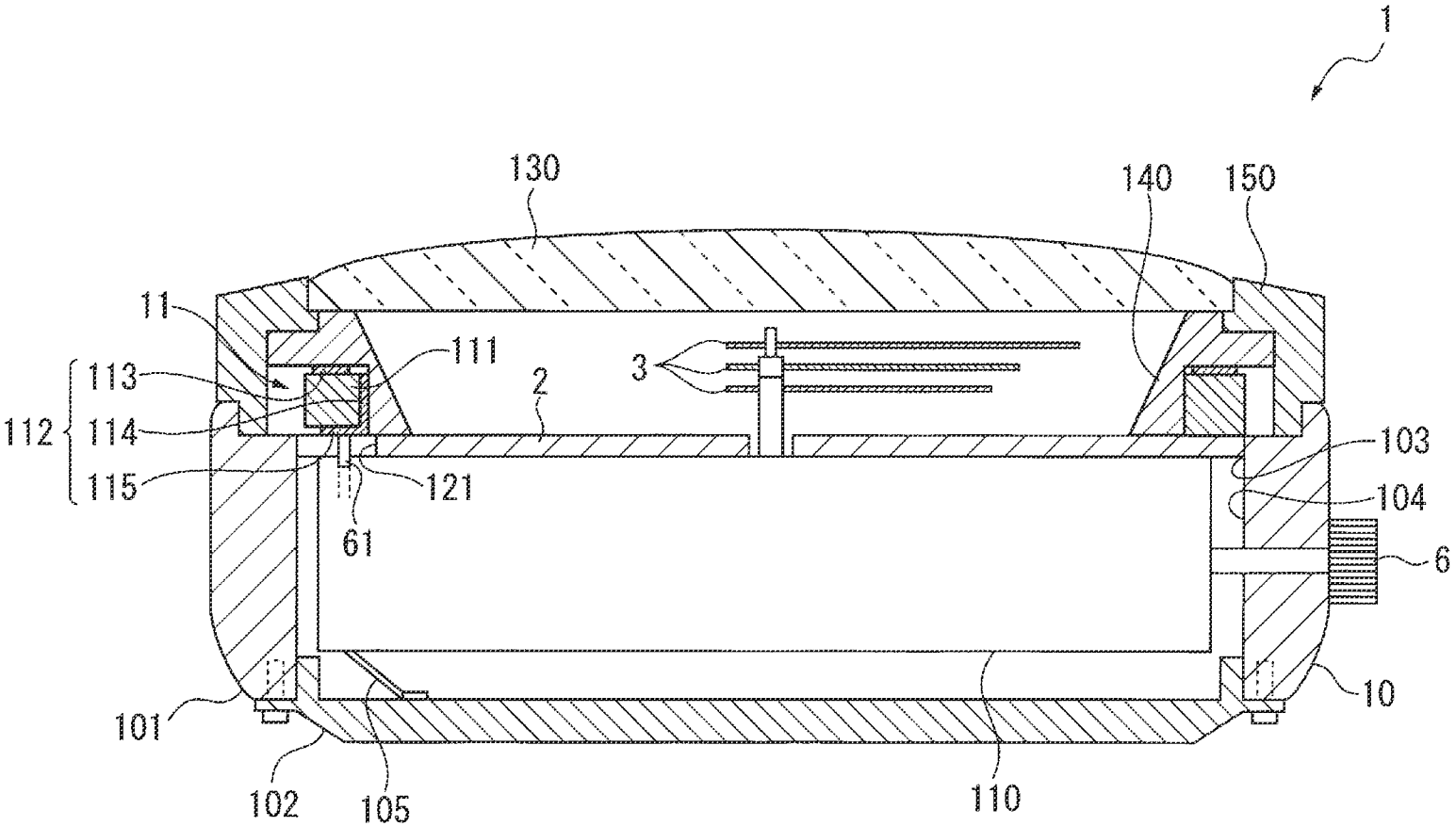
FIG. 2 is a schematic section view of an electronic device according to a preferred embodiment of the invention.
Figure 3:
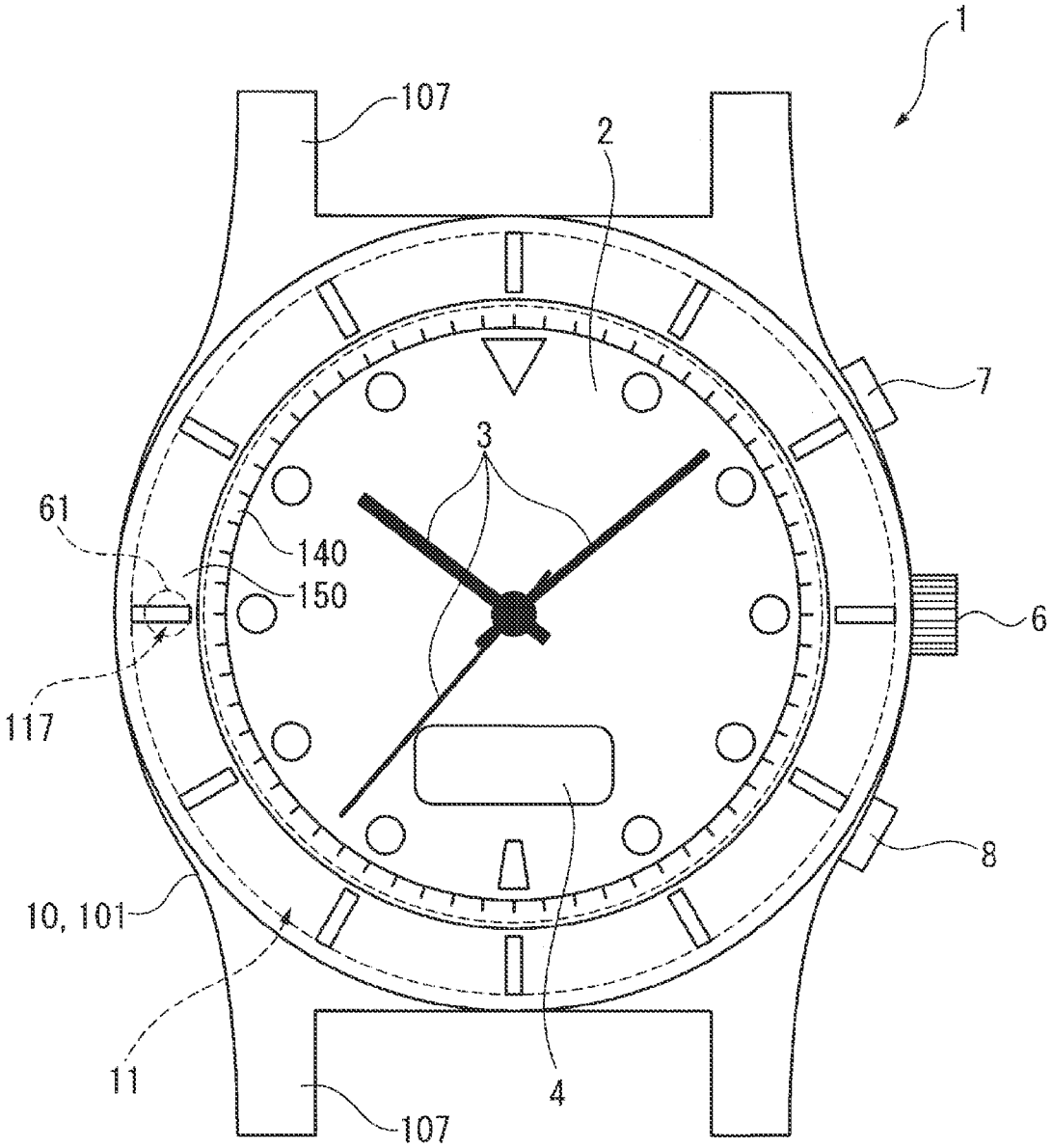
FIG. 3 is a plan view of an electronic device according to a preferred embodiment of the invention.

As shown in FIG. 2 and FIG. 3, the electronic device 1 has a module 110 that drives the hands 3, and a case 10 that houses the module 110.

The case 10 includes a cylindrical external case member 101 and a round back cover 102 that covers one of the openings in the case member 101 (the opening on the bottom side as seen in FIG. 2).

The case member 101 is made from an electrically non-conductive plastic material. The case of the invention in the accompanying claims is rendered by this case member 101.

Brass, stainless steel, titanium alloy, or other type of electrically conductive metal material is used for the back cover 102. The ground terminal 105 of the module 110 described below is connected to the back cover 102. The ground terminal 105 is connected to the ground potential of the reception unit 18 of the module 110. As a result, the back cover 102 is electrically connected to the ground potential of the reception unit 18 through the ground terminal 105, and reflects incident signals from the crystal 130 side toward the GPS antenna 11, that is, functions as a ground plate (reflector).

The back cover 102 is screwed to the one opening in the case member 101 (the bottom side as seen in FIG. 2). This forms a cavity 104 inside the case 10 with an open face 103 on the opposite side of the case member 101 (the top side of the case member 101 as seen in FIG. 2). The module 110 is held in this cavity 104.

The dial 2 is disposed to the end of the case member 101 where the open face 103 is formed.

A notched part 121 that connects the space on the crystal 130 side with the space on the module 110 side is formed in the outside perimeter of the dial 2, specifically near the 9:00 position of the electronic device 1.

The module 110 displays the time by means of the hands 3 described above and receives signals from the GPS satellites 5*a*, 5*b*, 5*c*, 5*d* shown in FIG. 1. The module 110 includes a circuit board 25 (see FIG. 4) that is populated with circuit devices (such as IC chips) for processing the time display and GPS functions, a drive mechanism not shown including a wheel train and stepper motor for driving the hands 3, and a storage battery 91 (see FIG. 5) that supplies power to other parts of the movement.

The circuit devices disposed to the circuit board 25 include a reception unit 18 (see FIG. 4) for processing signals received from the GPS satellites 5*a*, 5*b*, 5*c*, 5*d*, and a control unit 20 for controlling the drive mechanism. Of these circuit devices, the reception unit 18 is disposed in the middle of the circuit board 25 on the opposite side of the circuit board 25 (the back cover 102 side) as the GPS antenna 11 and LCD panel to avoid the effects of noise.

As shown in FIG. 2 and FIG. 3, the electronic device 1 has a ring-shaped GPS antenna 11 disposed along the outside circumference of the dial 2.

The GPS antenna 11 receives signals from the GPS satellites 5*a*, 5*b*, 5*c*, 5*d* described above, is disposed on the face side of the dial 2, and is configured so that the outside edge of the GPS antenna 11 substantially conforms to the shape of the outside edge of the dial 2. The outside diameter (the outside dimension), which is the largest dimension, of the GPS antenna 11 is smaller than the outside diameter (outside dimension) of the back cover 102. The outside diameter of the back cover 102 is thus larger than the outside diameter of the GPS antenna 11. Note that this GPS antenna 11 is described in further detail below.

The electronic device 1 has a dial ring 140 that houses the GPS antenna 11.

The dial ring 140 is an annular member made from a plastic material, that is, an electrically non-conductive material, and has a channel in which the GPS antenna 11 is held along the outside edge. The dial ring 140 is disposed around the dial 2 on the face side of the dial 2 (the crystal 130 side in the thickness direction of the electronic device 1), has a tapered (conical) surface that slopes toward the dial 2 on the inside circumference side, and has a calendar with 60 equally spaced markers printed on this sloped surface.

A bezel 150 is disposed to the outside circumference of the dial ring 140, and the crystal 130 that covers the hands 3 and the face of the dial 2 is disposed on the inside of the bezel 150.

The bezel 150 is a ring with the outside circumference continuous to the outside circumference of the case member 101, and is attached to the case member 101 of the case 10 by means of an interlocking ridge and channel configuration rendered on opposing mating surfaces, double-sided adhesive tape, or adhesive, for example. The bezel 150 holds the crystal 130 and presses and holds the dial ring 140 against the dial 2.

The GPS antenna 11 disposed in a groove in the dial ring 140 is disposed so that it is covered by the dial ring 140 and bezel 150.

As a result, the crystal 130 is disposed covering the face side of the module 110, the dial 2 is disposed between the crystal 130 and module 110, and the dial 2 and GPS antenna 11 are disposed between the dial 2 and the crystal 130.

The back cover 102 of the case 10 of the electronic device 1 is made from a metal material with outstanding appearance.

The case member 101, dial 2, dial ring 140 and bezel 150 are made of non-conductive materials, and the crystal 130 is also made from a non-conductive glass-like material. These members are appropriately surface finished to achieve the desired appearance. Note that while the non-conductive material used for the bezel 150 may be plastic as described above, a ceramic material that is harder, more resistant to scratching, and provides a more high quality appearance is preferred.

By using such materials, the dial ring 140, bezel 150, and crystal 130 disposed on the face side of the dial 2 (the top as seen in FIG. 2) are all non-conductive materials, and these members therefore do not affect the GPS antenna 11 as electromagnetic shields.

GPS Antenna

Figure 4:
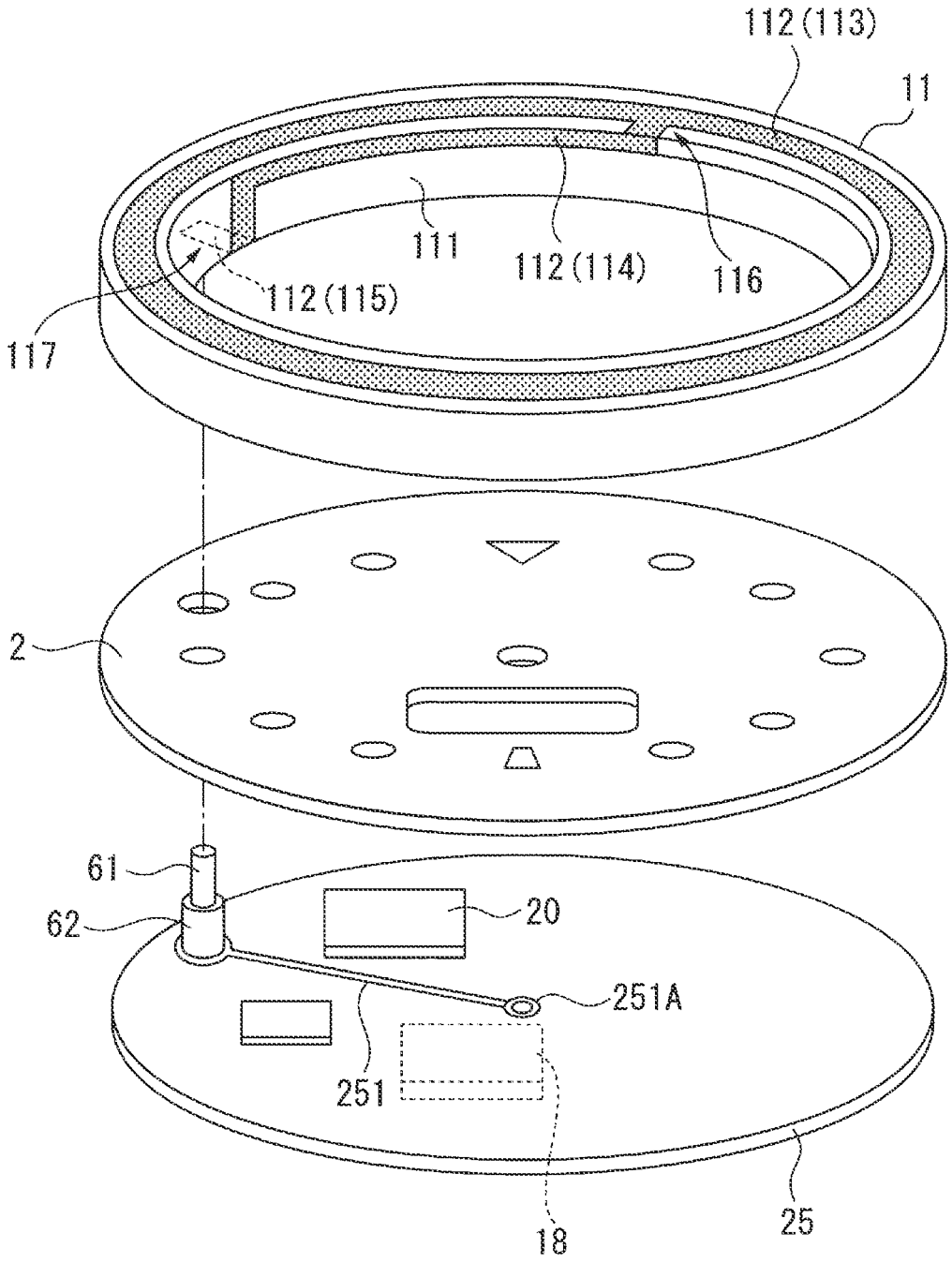
FIG. 4 is an exploded view of a GPS antenna incorporated in an electronic device according to a preferred embodiment of the invention.

As shown in FIG. 4, the GPS antenna 11 has a ring-shaped dielectric substrate 111 that is rectangular in section, and an antenna electrode 112 disposed to the surface thereof. Note that this GPS antenna 11 renders an antenna according to the invention, and the antenna electrode 112 renders an antenna unit of the invention.

The dielectric substrate 111 functions to shorten the signal wavelength. More specifically, the satellite signals transmitted from the GPS satellites 5*a*, 5*b*, 5*c*, 5*d* are circularly polarized waves with a frequency of 1.575 GHz and wavelength of 19 cm. To receive such satellite signals with a loop antenna, the distance between the ground plate (reflector) and unbalanced loop antenna not requiring a balun is preferably set to approximately 0.10 to 0.25 wavelength. If a smaller gap is used, reception performance may drop due to the image antenna effect.

To receive satellite signals with a frequency of 1.575 GHz without using a dielectric, the distance between the loop antenna and the ground plate must be 3 to 4.8 cm, which is a dimension that cannot be used in a wristwatch. However, by disposing the antenna electrode 112 on the dielectric substrate 111, the wavelength of the satellite signals can be shortened by the dielectric substrate 111, and this shortened wavelength can be received by the antenna electrode 112.

Note that for a dielectric substrate 111 with a relative static permittivity of $\in_r$, the signal wavelength shortening ratio is $1/(\in_r)^{1/2}$. As a result, the signal wavelength can be shortened even more by increasing the relative static permittivity of $\in_r$.

However, if a dielectric with a high relative static permittivity of $\in_r$ is used, the frequency bandwidth becomes narrower with a sharper reception characteristic that makes tuning more difficult, and reception performance may drop due to frequency shifting when worn on the wrist.

The dielectric substrate 111 that can actually be used as a dielectric therefore has relative static permittivity $\in_r$ of less than or equal to 20, and preferably 4 to 10. Examples of such dielectric substrate 111 materials include ceramics of which alumina ($\in_r$=8.5) is a main component, ceramics such as Micalex ($\in_r$=6.5-9.5) containing mica, glass ($\in_r$=5.4-9.9), and diamond ($\in_r$=5.68).

By using such a dielectric substrate 111, satellite signals with a wavelength of 19 cm can be received by the antenna electrode 112 of a loop antenna with an approximately 3 cm diameter (approximately 9.4 cm circumferential length) (when relative static permittivity $\in_r$ is 5), and the GPS antenna 11 can be disposed in a common wristwatch case.

Note that by using this dielectric substrate 111, the appropriate gap between the loop antenna and ground plate is approximately 0.8 to 2.0 cm. Because the thickness of a typical wristwatch is approximately 0.8-1.6 cm, rendering this gap between the loop antenna and ground plate does not interfere with the normal use and function of a wristwatch.

The antenna electrode 112 can be rendered in a line in unison with the dielectric substrate 111 by, for example, printing a copper, silver, or other conductive material on the surface of the dielectric substrate 111, or by affixing a conductive metal plate of copper or silver, for example, on the surface of the dielectric substrate 111. Note, further, that a pattern may be rendered on the surface of the dielectric substrate 111.

The antenna electrode 112 includes the main antenna unit 113, a coupling unit 114, and a power supply unit 115.

The main antenna unit 113 is the ring-shaped line part disposed on the top surface of the dielectric substrate 111, that is, the opposite side of the dielectric substrate 111 as the side facing the back cover 102, and receives signals entering through the crystal 130 or reflected by the back cover 102.

The main antenna unit 113 is formed so that the circumferential length thereof is approximately 1 wavelength (0.9 wavelength to 1.3 wavelength) of the wavelength to which the signals to be received are shortened by the dielectric substrate 111. More particularly, the circumference of the main antenna unit 113 is optimally the length of 1.1 wavelength. More specifically, when the relative static permittivity $\in_r$ of the dielectric substrate 111 is 20, the diameter of the main antenna unit 113 is approximately 3 cm.

A junction 116 is formed at a place on the inside circumference part of the main antenna unit 113, and the coupling unit 114 is formed extending from this junction 116 to the inside circumference side of the dielectric substrate 111. The coupling unit 114 is formed in the circumferential direction along the inside circumference side of the dielectric substrate 111. The distal end of the coupling unit 114, that is, the opposite end as the end connected to the junction 116, extends toward the bottom side of the dielectric substrate 111, and the power supply unit 115 connected to the coupling unit 114 is formed on the bottom side of the dielectric substrate 111.

As shown in FIG. 2 and FIG. 3, the power supply unit 115 is formed at a position opposite the notched part 121 of the 2 at the 9:00 position of the electronic device 1, and the end part of a connection pin 61 passing through the notched part 121 contacts the power supply unit 115 at one point (power supply node 117). The length from this junction 116 through the coupling unit 114 to the power supply point 117 is approximately ¼ of the wavelength of the signals received by the GPS antenna 11.

The connection pin 61 that functions as a connection member touching the power supply node 117 of the power supply unit 115 is supported so that it can rise freely in a connector base part 62 standing at the 9:00 position of the electronic device 1. By thus disposing the connection pin 61 at 9:00, structural interference with the crown 6 disposed at 3:00 and the buttons 7 and 8 disposed at 2:00 and 4:00 as external operating members can be avoided.

In addition, the connection pin 61 and connector base part 62 are electrically connected, and the connector base part 62 is connected to the reception unit 18 on the circuit board 25.

The connector base part 62 is basically cylindrically shaped, and a coil spring or other urging member disposed inside the cylinder urges the connection pin 61 to the power supply unit 115 side. As a result, the connection pin 61 is pressed against the power supply node 117, and the connection between the connection pin 61 and power supply node 117 is maintained even when the GPS wristwatch 1 is subject to shock, for example.

As shown in FIG. 4, the connector base part 62 is connected to a connection node 251A in the middle of the circuit board 25 by a wire lead 251, and is connected at this connection node 251A to the reception unit 18 disposed on the back cover 102 side of the circuit board 25. Note that in order for a single wavelength loop antenna such as the GPS antenna 11 in this embodiment of the invention to efficiently receive circularly polarized waves, the connection node 251A is preferably located in the middle part of the circuit board 25.

On the other hand, when the connection node 251A is thus disposed in the middle of the circuit board 25, the wiring becomes longer and signal loss increases. In order to solve this problem, a low noise amplifier (LNA) 28 (see FIG. 5) as described below may be disposed between the GPS antenna 11 and the reception unit 18, and more particularly between the GPS antenna 11 and a bandpass filter not shown that extracts the 1.5 GHz satellite signals, to compensate for signal loss.

Note that the method of connecting the connector base part 62 and the reception unit 18 is not limited to the foregoing. For example, the connector base part 62 may be connected to a printed circuit line on the circuit board 25 and connected to the reception unit 18 through this printed circuit.

Further alternatively, the antenna electrode 112 may be formed by applying a metal plating on the top surface of the plastic dial ring 140 as the GPS antenna 11 according to the invention, and a GPS antenna 11 rendered in unison with the dial ring 140 may be used. Because the top side of the dial ring 140 where the antenna electrode 112 is formed in this configuration is covered by the bezel 150, the antenna electrode 112 is not exposed to the outside and the appearance can be improved.

In this embodiment of the invention the electrically conductive back cover 102 also serves as a ground plate and functions as the ground plate of the GPS antenna 11. The outside diameter of the back cover 102 is greater than the outside diameter of the GPS antenna 11. The antenna electrode 112 of the GPS antenna 11 is flat and superimposed on the back cover 102 in the thickness direction of the electronic device 1.

Furthermore, because the back cover 102 is metal, it prevents the user's wrist from affecting the GPS antenna 11 in addition to functioning as a ground plate.

Figure 6:
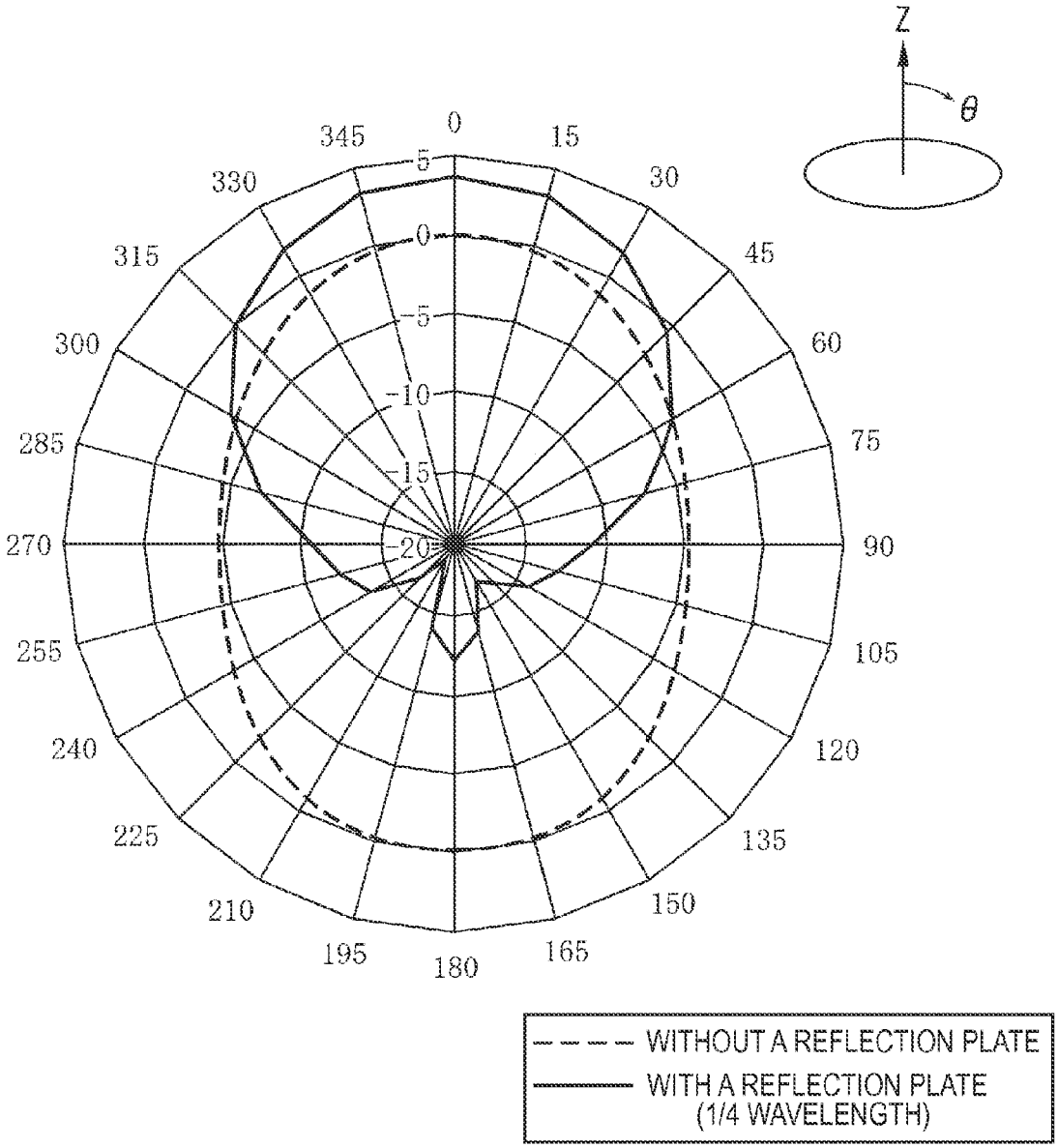
FIG. 6 shows the simulated results of the radiation pattern of a GPS antenna with and without a reflection plate.

FIG. 6 shows the simulated radiation pattern of the GPS antenna 11. As shown in FIG. 6, the direction of the zenith on the crystal 130 side of the GPS antenna 11 is the Z axis, and the angle of inclination to the Z axis is angle θ. Note that the angle θ of the back cover 102 side of the GPS antenna 11 is 180 degrees.

As shown in FIG. 6, if the back cover 102 is plastic, there is no ground plate and signals can also be received from the back cover 102 side, that is, the wrist side. As a result, the resonance frequency of the antenna differs when the electronic device is worn and subject to the effect of the adjacent wrist, and when the electronic device is not worn, and performance differs undesirably.

However, when the back cover 102 is metal as in this embodiment of the invention, the back cover 102 functions as a ground plate (reflector) and improves antenna gain near an angle θ of 0 degrees directly above the electronic device 1. In addition, because the back cover 102 is metal, antenna gain on the back cover side at an angle θ near 180 degrees is small due to the shield effect of the back cover 102. As a result, the effects of the wrist can be avoided, there is substantially no difference in antenna performance in this embodiment of the invention when the electronic device 1 is worn and not worn, and stable reception performance can be achieved.

Circuit Configuration of the Electronic Device 1

The configuration of the circuits in the electronic device 1 is described next.

Figure 5:
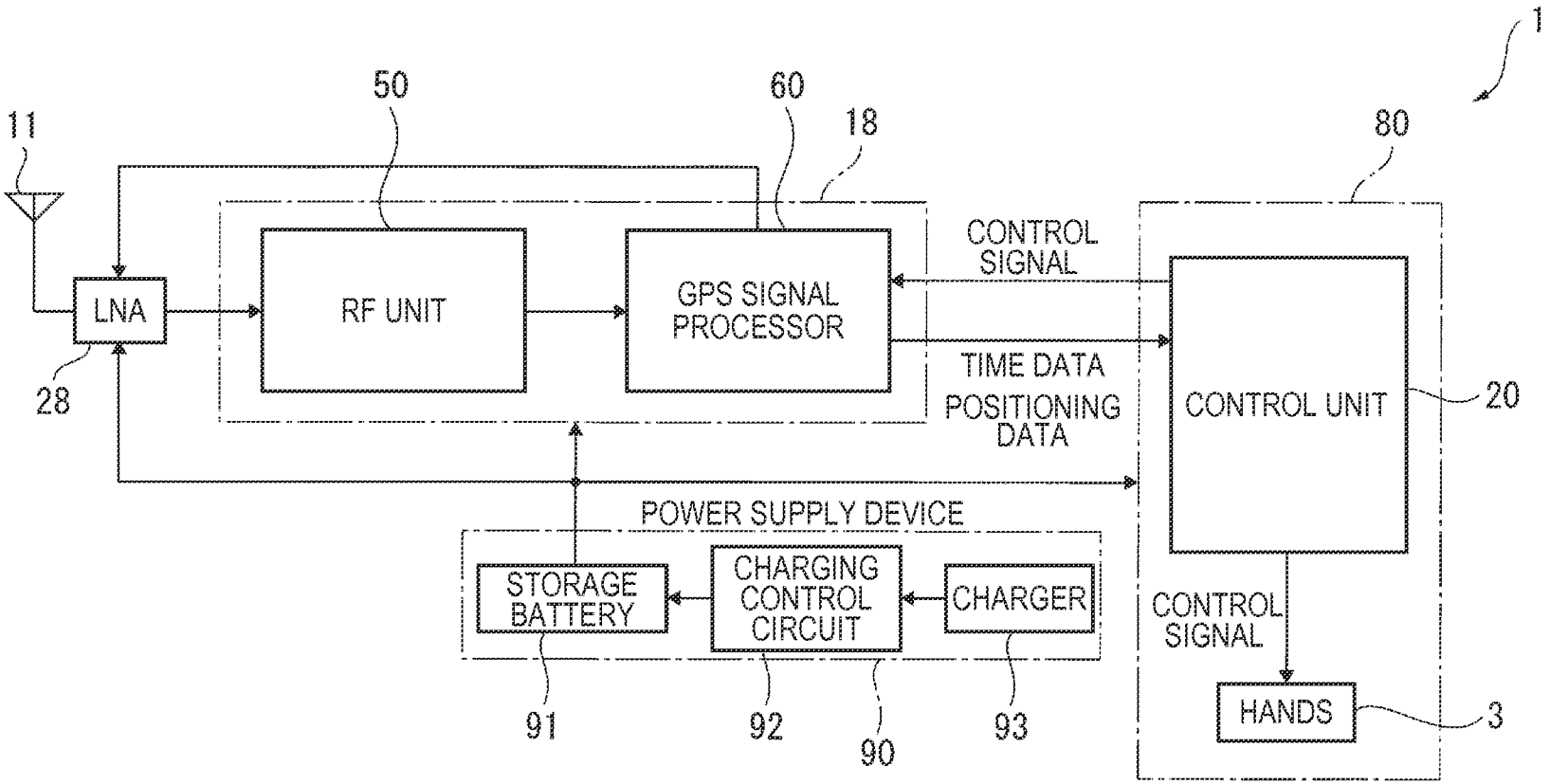
FIG. 5 is a block diagram showing the main hardware configuration of an electronic device according to a preferred embodiment of the invention.

FIG. 5 shows the main hardware configuration of the electronic device 1.

As shown in FIG. 5, the electronic device 1 includes a GPS antenna 11, a LNA 28 (low noise amplifier) as a signal amplifier means, a reception unit 18, a time display device 80, and a power supply device 90.

The GPS antenna 11 is a loop antenna for receiving satellite signals from a plurality of GPS satellites 5*a*, 5*b*, 5*c*, 5*d*.

The output of the electronic device 1 is connected to the LNA 28.

The satellite signals received by the GPS antenna 11 are input to the LNA 28. The output of the LNA 28 is connected to the reception unit 18.

The reception unit 18 includes primarily an RF (radio frequency) unit 50 and a GPS signal processor 60. The RF unit 50 and GPS signal processor 60 execute a process for acquiring satellite information such as orbit information and GPS time information that are carried in the navigation message received in satellite signals in the 1.5 GHz band.

Note that the reception unit 18 in this embodiment of the invention has an eight channel reception circuit, for example, so that eight satellite signals can be received and captured simultaneously.

The RF unit 50 is a common device used in GPS receivers including a down-converter for converting high frequency signals to intermediate frequency band signals, and an A/D converter for converting the analog intermediate frequency band signals to digital signals.

The GPS signal processor 60 includes a DSP (digital signal processor), CPU (central processing unit), SRAM (static random access memory), and a RTC (real-time clock) not shown, and executes a process that demodulates a baseband signal from the digital signal (intermediate frequency band signal) output from the RF unit 50.

Based on the satellite signal search result, the GPS signal processor 60 outputs a control signal to a control signal input terminal not shown of the LNA 28, and controls operation of the LNA 28.

More specifically, the GPS signal processor 60 controls the operating state of the LNA 28 when the signal strength of the captured satellite signal is less than a preset threshold value.

If the signal strength of the captured satellite signal is greater than or equal to this preset threshold value, the GPS signal processor 60 stops operation of the LNA 28.

The GPS signal processor 60 also controls operation of the reception unit 18 according to the reception mode.

The time display device 80 includes the control unit 20 and hands 3.

The control unit 20 controls the reception unit 18. More specifically, when a button 7 or 8 is pressed continuously to unconditionally start the reception process, and when a scheduled reception time is set and the scheduled time arrives, the control unit 20 sends a control signal to the reception unit 18 and controls the reception operation of the reception unit 18. The control unit 20 also controls driving the hands 3 through an internal drive circuit not shown.

Internal time information is stored in the control unit 20. This internal time information is information about the time that is kept internally by the electronic device 1. The internal time information is updated based on a reference clock signal produced by an oscillation circuit, for example. As a result, even if the power supply to the reception unit 18 is stopped, the internal time information continues to be updated and movement of the hands 3 can continue.

When the timekeeping mode is selected, the control unit 20 controls operation of the reception unit 18 to acquire the GPS time information, and corrects and stores the internal time information based on this GPS time information. More specifically, the internal time information is adjusted to the UTC (Universal Coordinated Time), which is obtained by subtracting the cumulative leap seconds (current 15 seconds) inserted to the acquired GPS time information since 6 Jan. 1980. In addition, if time difference (time zone) data is also stored, this time difference is added to acquire and store the current time at the current location.

When the navigation (positioning) mode is selected, the control unit 20 controls operation of the reception unit 18 to acquire the GPS time information and positioning data, and correct and store the internal time information based on the GPS time information, cumulative leap seconds, and time difference data determined from the current location. Note that data describing the relationship between the positioning data and time difference data is previously stored in memory.

The power supply device 90 includes the storage battery 91, a charging control circuit 92, and a charger 93.

The storage battery 91 supplies drive power to the LNA 28, reception unit 18, and time display device 80.

The charger 93 includes, for example, a rotary pendulum not shown that is disposed freely rotatably inside the case member 101, and a generator that converts rotation of the rotary pendulum to electrical power. Note that the charger 93 is not limited to an internal configuration that includes a generator, and could be rendered independently of the electronic device 1 and supply power through an external connector disposed in the case member 101. This external connector may also be a contact or contactless device.

The charging control circuit 92 supplies power supplied from the charger 93 to and charges the storage battery.

Reception Process

The reception process is described next.

Satellite signals are received from a plurality of GPS satellites 5*a*, 5*b*, 5*c*, 5*d* by the GPS antenna 11, and the received satellite signals are output to the LNA 28.

Based on the control signal from the GPS signal processor 60, the LNA 28 suitably amplifies and outputs the received satellite signals to the reception unit 18. More specifically, when an ON signal (such as a high level signal) is input from the GPS signal processor 60, the LNA 28 amplifies the satellite signal by means of an operating amplifier, for example, and outputs to the reception unit 18. When an OFF signal (such as a low level signal) is input, the LNA 28 outputs the input satellite signal to the reception unit 18 without amplification.

The RF unit 50 of the reception unit 18 converts the high frequency satellite signal output from the LNA 28 to an intermediate frequency signal, and converts the analog signal to a digital signal.

The GPS signal processor 60 of the reception unit 18 produces a local code with the same pattern as each C/A code, and determines the correlation between the C/A codes carried in the baseband signals and the local codes. The GPS signal processor 60 adjusts the output timing of the local code to obtain the peak correlation between the received C/A code and the local code, and when this correlation equals or exceeds a set threshold value determines that the local code is synchronized with the GPS satellites 5*a*, 5*b*, 5*c*, 5*d* (that is, signals from the GPS satellites 5*a*, 5*b*, 5*c*, 5*d* are captured).

The GPS system uses CDMA (Code Division Multiple Access) enabling all GPS satellites 5*a*, 5*b*, 5*c*, 5*d* to transmit satellite signals on the same frequency using different C/A codes. Therefore, by detecting the C/A code contained in each received satellite signal, the GPS satellites 5*a*, 5*b*, 5*c*, 5*d* that can be captured can be found.

The GPS signal processor 60 mixes the local code with the same pattern as the C/A code of the captured GPS satellite 5*a*, 5*b*, 5*c*, 5*d* with the baseband signal, demodulates the navigation message, and acquires satellite information including the orbit information and GPS time information contained in the navigation message.

The GPS signal processor 60 then outputs the acquired time data and positioning data to the control unit 20 of the time display device 80.

Based on the time data and positioning data from the GPS signal processor 60, the control unit 20 of the time display device 80 adjusts and stores the internal time information and moves the hands 3 appropriately to adjust the displayed time.

Effect of the First Embodiment

The effect of an electronic device 1 according to the first embodiment of the invention described above is described below.

(1) In this embodiment of the invention a conductive member that reflects RF signals is rendered as the back cover 102, and the linear antenna electrode 112 of the GPS antenna 11 is disposed around the dial 2.

As a result, the GPS antenna 11 and back cover 102 can be disposed with sufficient distance therebetween to obtain good reception performance, and the reception performance of the GPS antenna 11 can be improved.

In addition, the back cover 102 functions as a reflector, can prevent change in the antenna tuning frequency even when used in a wristwatch, can therefore improve GPS antenna 11 characteristics, and can achieve good reception characteristics.

More particularly, in the thickness direction of the electronic device 1, the GPS antenna 11 is located above the dial 2 on the crystal 130 side, and between the dial ring 140 and bezel 150 at a position farther from the back cover 102 than the dial 2.

As a result, when used in a wristwatch, the GPS antenna 11 can be desirably separated from the back cover 102 without increasing the thickness of the electronic device 1, and good reception performance can be achieved.

(2) The conductive back cover 102 is larger than the outside dimension of the GPS antenna 11.

As a result, the signal reflection efficiency of the back cover 102 is improved and reception performance can be improved.

More particularly, because the back cover 102 can be designed larger than the outside dimensions of the dial 2, the RF signal reflection efficiency can be easily improved and the GPS antenna 11 characteristics can be easily improved.

(3) The GPS antenna 11 is disposed between the bezel 150 and dial ring 140, which is formed in a ring shape from a non-conductive material, and the GPS antenna 11 is covered by the dial ring 140 and bezel 150.

As a result, RF signals are not blocked and good reception performance can be achieved.

In addition, the GPS antenna 11 is not exposed to the outside and impairment of the appearance can be prevented. Yet further, because the GPS antenna 11 is disposed between the dial ring 140 and bezel 150 that are disposed around the dial 2, the GPS antenna 11 can be prevented from impeding view of the dial 2.

(4) Antenna performance can be optimized because the circumferential length of the antenna electrode 112 of the loop antenna used as the GPS antenna 11 disposed on the dielectric substrate 111 is approximately equal to 1 wavelength of the RF signal after wavelength shortening by the dielectric substrate 111.

(5) The dial 2 is used as an information display unit made from a non-conductive material.

When a conductive dial 2 is used, for example, the dial 2 functions as a ground plate, the GPS antenna 11 is closely adjacent to the dial 2 that functions as a ground plate, and reception characteristics may be degraded.

However, because this embodiment of the invention renders the dial 2 from a non-conductive material, the dial 2 does not function as a ground plate, an appropriately separated metal back cover 102 can be made to function as a ground plate, and RF signals can be desirably received.

(6) The antenna electrode 112 of the GPS antenna 11 is rendered by a ring-shaped main antenna unit 113 disposed on top of a ring-shaped dielectric substrate 111, a coupling unit 114 that goes from a junction at one point on the inside circumference edge of the main antenna unit 113 around the outside of the dielectric substrate 111, and a power supply unit 115 that is connected to the coupling unit 114 at the opposite end as the junction 116 and is formed on the bottom side of the dielectric substrate 111. The dial 2 has a notched part 121 at a position opposite the power supply unit 115, and a connection pin 61 is disposed passing through the notched part 121 and urged from the module 110 side toward the power supply point 117.

As a result, contact between the power supply unit 115 and dial 2, and contact between the connection pin 61 and dial 2, can be prevented, and the antenna electrode 112 and the reception unit 18 of the circuit board 25 can be reliably electrically connected by the connection pin 61. In addition, because the connection pin 61 is urged to the power supply point 117 side, a good connection between the connection pin 61 and power supply point 117 can be maintained even if the timepiece is subject to a sharp impact.

Embodiment 2

A second embodiment of the invention is described next with reference to the accompanying figures.

This second embodiment of the invention displays the time using a liquid crystal display device instead of displaying the time using a dial 2 as described in the first embodiment.

Figure 7:
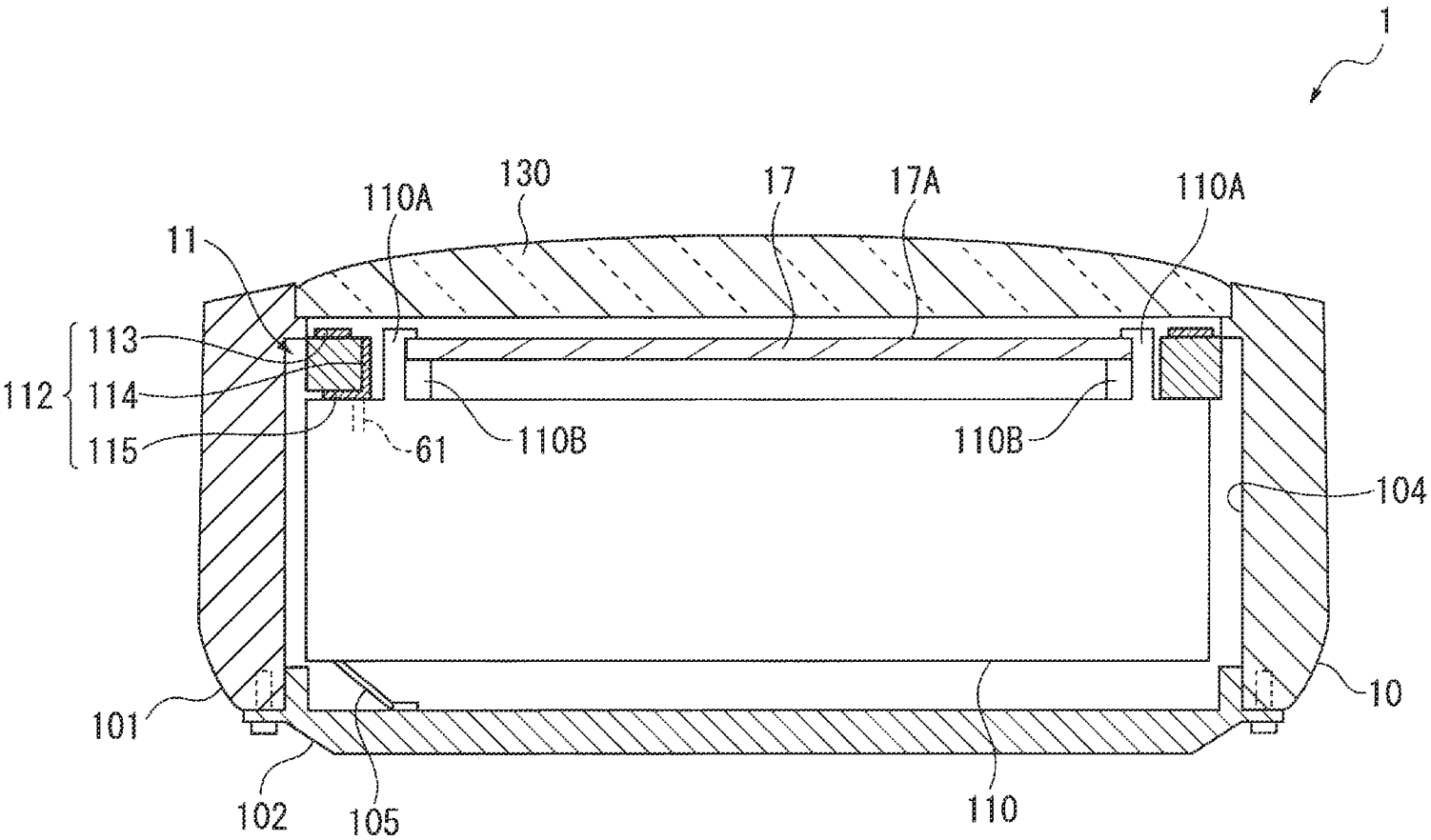
FIG. 7 is a schematic section view of an electronic device according to a second embodiment of the invention.

FIG. 7 is a schematic section view of a electronic device 1 according to the second embodiment of the invention. Note that like parts in this embodiment and the first embodiment are identified by the same reference numerals in the figures, and further description thereof is omitted.

The case 10 in this second embodiment of the invention includes a cylindrical external case member 101 made from an electrically non-conductive material and a round back cover 102 that covers one of the openings in the case member 101 (the opening on the bottom side as seen in FIG. 7).

A module 110 that has an LCD panel 17, which is a display panel used as a flat information display unit for displaying the time, and controls the LCD panel 17 is housed inside the case member 101. Note that the case member 101 does not have the dial ring 140 and bezel 150 of the first embodiment.

The module 110 includes an LCD panel holding unit 110A that holds the LCD panel 17 with the display side 17A thereof facing the crystal 130, and a connector 110B that electrically connects the module 110 to the LCD panel 17.

It should be noted that while the LCD panel 17 has minute transparent electrodes and other conductive members, they occupy an extremely small portion of the total area and do not interfere with RF signal reception, and the LCD panel 17 can therefore be treated as an effectively non-conductive member.

The GPS antenna 11 is disposed on the outside of the LCD panel holding unit 110A along the outside of the module 110. That is, the GPS antenna 11 is disposed on the outside circumference side of the LCD panel 17.

The second embodiment of the invention shown in FIG. 7 differs from the first embodiment that uses a dial 2 by using an LCD panel 17 to display information, and affords the following effect in addition to effects (1) to (4) and (6) of the first embodiment described above.

(7) An LCD panel 17 is used as an information display unit that is made from a non-conductive material.

As a result, RF signals can be reflected by the back cover 102 that functions as a ground plate without being blocked by the LCD panel 17, signal reflection efficiency can be improved, and radio signals can be efficiently received by the GPS antenna 11.

(8) The GPS antenna 11 is located on the outside circumference side of the LCD panel 17.

As a result, an increase in the thickness of the electronic device 1 can be prevented, and reception performance can be improved because the GPS antenna 11 can be rendered with a large diameter.

Embodiment 3

A third embodiment of the invention is described next with reference to the accompanying figures.

This third embodiment of the invention uses an electrically conductive cover member 101A instead of the electrically non-conductive case member 101 of the first embodiment.

Figure 8:
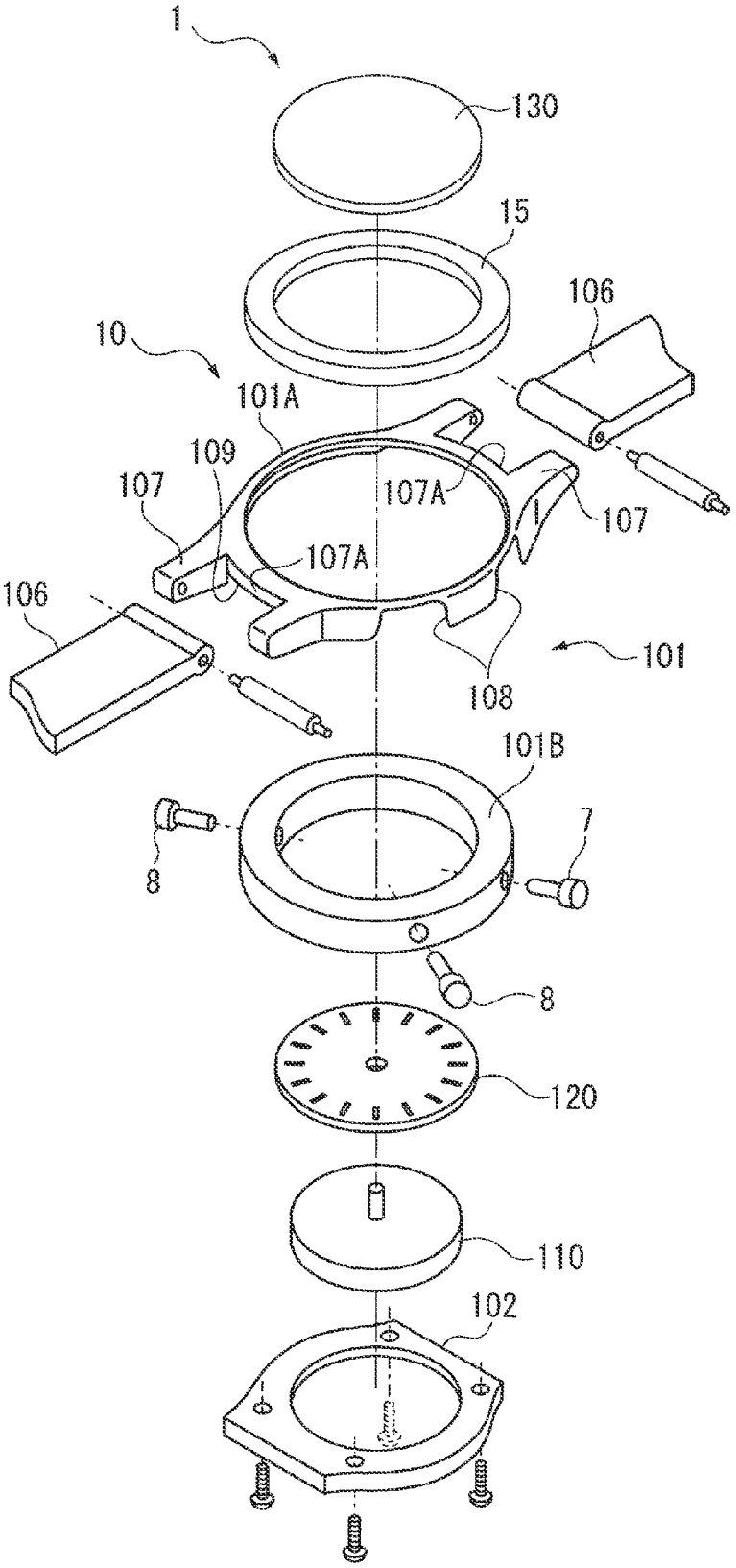
FIG. 8 is an exploded oblique view in part of an electronic device according to a third embodiment of the invention.

FIG. 8 is an exploded oblique view of a electronic device 1 according to the third embodiment of the invention.

The case 10 according to the third embodiment of the invention has a case member 101 of which part is made from an electrically non-conductive material.

This case member 101 includes a cover member 101A made from a conductive material (such as stainless steel or other metal), and a non-conductive case ring 101B that is disposed inside the cover member 101A. The surface of the case ring 101B is coated with a metallic coating to match the appearance of the metal cover member 101A.

A conductive back cover 102 is disposed to one of the openings in the case member 101, and more specifically to one end in the axial direction of the case ring 101B (the bottom as seen in FIG. 8).

A crystal 130 and a bezel unit 15 in which the GPS antenna 11 is rendered are disposed to the other opening of the case member 101 on the face side, that is, in the opening of the cover member 101A (the top side in FIG. 8). This bezel unit 15 may be rendered by the dial ring 140 and bezel 150 of the first embodiment, for example.

Note that the bezel unit 15 is disposed placed at one end of the case ring 101B in the axial direction (the top in FIG. 8). More specifically, the outside edge of the GPS antenna 11 is rendered substantially coincident to the outside edge of the module 110 in the first embodiment of the invention, but in this third embodiment the outside diameter of the GPS antenna 11 is greater than the outside diameter of the module 110.

Voids 108 that accommodate the buttons 7 and 8 for external operations are rendered in the cover member 101A. Voids 109 are also rendered in cover member 101A at the side edge of the back cover 102 in the space 107A between the lugs 107 used to attach a band 106. The cover member 101A and back cover 102 are not in contact with each other and are non-conducting, and the cover member 101A therefore does not function as a ground plate (reflector).

This third embodiment of the invention shown in FIG. 8 uses an case member 101 including a conductive cover member 101A and a non-conductive case ring 101B, and thus differs from the first embodiment that uses a case member 101 made from a non-conductive material. In addition to the effects (1) to (6) of the first embodiment, this embodiment also has the following effect.

(9) By using a metal cover member 101A as the case member 101, the appearance of the case member 101 can be improved.

In addition, voids 108 for buttons and voids 109 are rendered in the cover member 101A. As a result, radio signals can be received through the button voids 108 and voids 109 even when using a metal cover member 101A, and a drop in radio signal reception performance can be minimized.

Other Embodiments

It will be obvious to one with ordinary skill in the related art that the invention is not limited to the foregoing embodiments, and can be modified and improved in many ways without departing from the scope of the accompanying claims.

The GPS antenna 11 in the foregoing embodiments is rendered with the coupling unit 114 formed along the inside circumference of the dielectric substrate 111 from the junction 116 of the main antenna unit 113, but the invention is not so limited.

Figure 9:
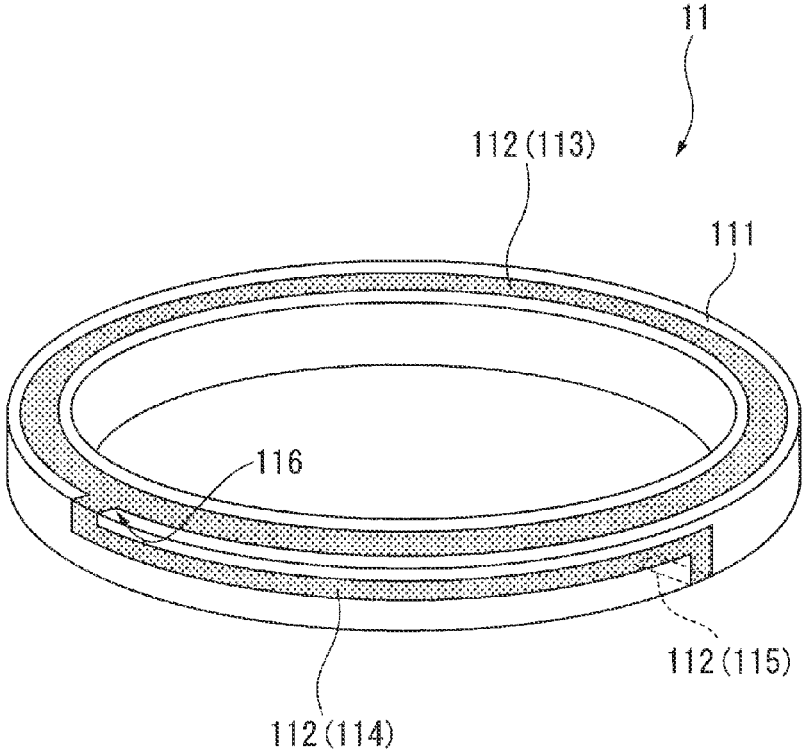
FIG. 9 is an oblique view of a GPS antenna used in an electronic device according to another embodiment of the invention.

For example, as shown in the GPS antenna 11 in FIG. 9, a configuration having the junction 116 disposed to the outside circumference side of the main antenna unit 113, and the coupling unit 114 formed extending from this junction 116 to the outside circumference side of the dielectric substrate 111 and continuing circumferentially along the outside surface is also conceivable.

The foregoing embodiments are also described as using a circular GPS antenna 11, but the invention is not limited to circular forms.

Figure 10:
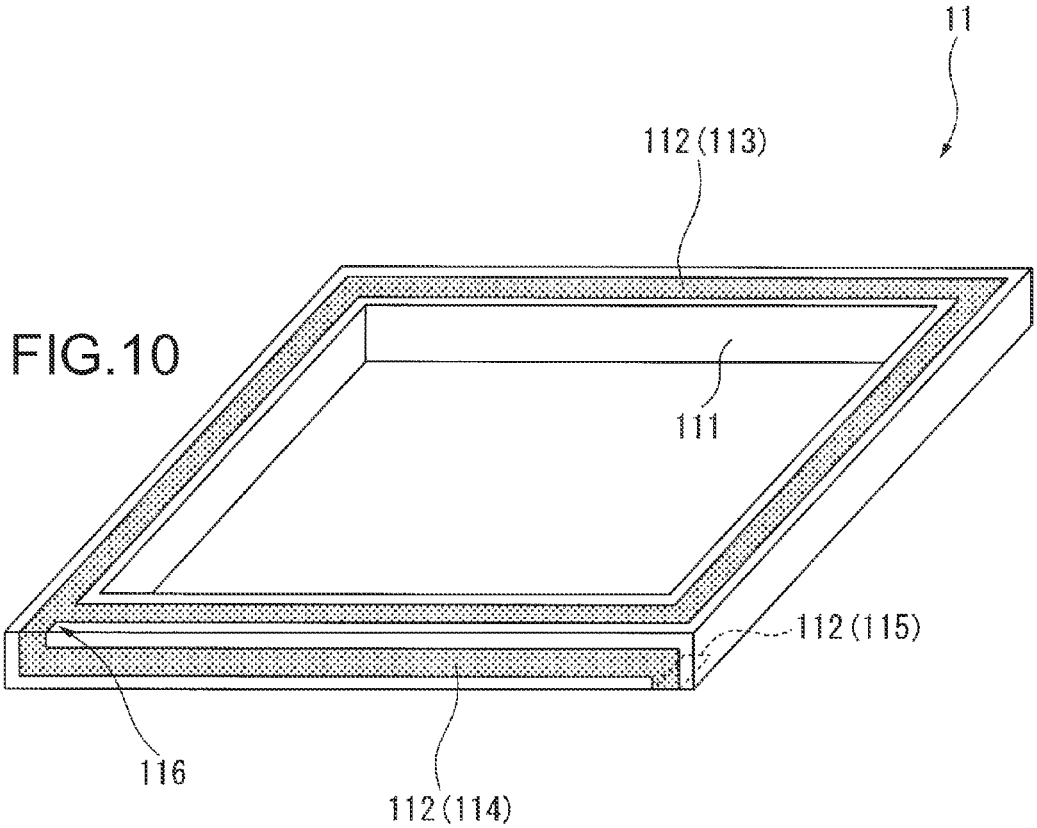
FIG. 10 is an oblique view of a GPS antenna used in an electronic device according to yet another embodiment of the invention.

For example, in a timepiece with a rectangular outside shape, such as in a timepiece with a digital display, an GPS antenna 11 that is square or rectangular according to the shape of the timepiece can be used as shown in FIG. 10.

With a square GPS antenna 11 such as shown, the circumferential length of the antenna electrode 112 can be increased compared with using a ring-shaped GPS antenna 11 in a flat square timepiece, and antenna performance can be further improved. Furthermore, by using a square GPS antenna 11 in a square timepiece, space inside the timepiece can be used effectively to, for example, increase the size of the digital display.

A loop antenna having a ring-shaped main antenna unit 113 is described as an example of the GPS antenna 11 above, but the invention is not so limited. The main antenna unit 113 may, for example, be C-shaped as shown in FIG. 11.

Figure 11:
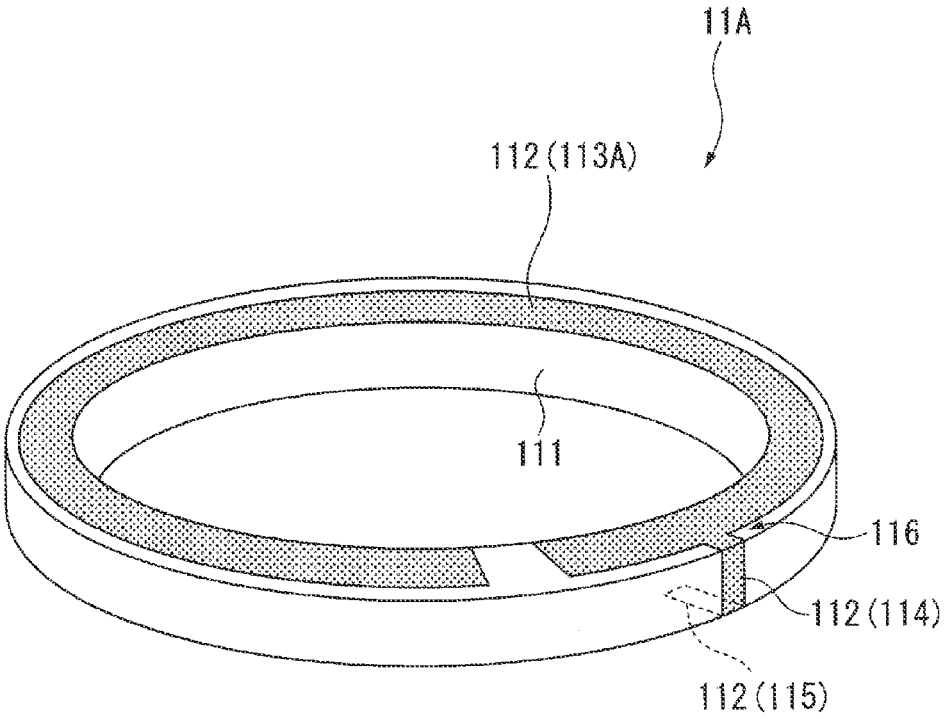
FIG. 11 is an oblique view of a GPS antenna used in an electronic device according to yet another embodiment of the invention.

Circularly polarized waves can also be received with the GPS antenna 11A shown in FIG. 11 by rendering the junction 116 connected to the coupling unit 114 at a position ¼ wavelength from one end of the C-shaped main antenna unit 113A.

Yet further, the foregoing embodiments describe a GPS antenna 11 having a single power supply unit 115, but a GPS antenna 11C having a plurality of power supply units 115 is also conceivable. A GPS antenna 11 with a plurality of power supply units 115 may be rendered by, for example, disposing two power supply units at two orthogonal power supply points, that is, so that the phase difference between the two power supply units 115 is 90°. With this type of GPS antenna 11 there are also two connection pins 61 corresponding to the two power supply units 115, and the satellite signals are transmitted from these two connection pins 61 to the circuit board 25. The circuit board 25 executes a reception process for circularly polarized waves by adjusting the phase difference of these two paths and inputting the signals to the reception unit 18.

The invention is also not limited to disposing the coupling unit 114 on the side of the dielectric substrate 111, and a configuration in which the main antenna unit 113 and power supply unit 115 are connected through a hole passing in the axial direction through the dielectric substrate 111, for example, is also conceivable.

A connection pin 61 is described as an example of a connection member that contacts the power supply unit 115 above, but the invention is not limited to such pin members. For example, a contact plate rendered like a flat spring may be used as the connection member. In such a configuration the urging force of the flat spring assures that the contact plate contacts the power supply point 117 with a specific contact pressure.

The first to third embodiments above are described using GPS satellites 5*a*, 5*b*, 5*c*, 5*d* as an example of a positioning information satellite, but the positioning information satellite of the invention is not limited to GPS satellites 5*a*, 5*b*, 5*c*, 5*d* and the invention can be used with Global Navigation Satellite Systems (GNSS) such as Galileo (EU), GLONASS (Russia), and Beidou (China), and other positioning information satellites that transmit satellite signals containing time information, including the SBAS and other geostationary or quasi-zenith satellites.

The wrist-worn electronic device of the invention is also not limited to configurations for receiving satellite signals from positioning information satellites, and may also be used with short-range receivers for receiving circularly polarized RF tags that use the 900 MHz band (a 900-MHz RFID function), for example.

The wrist-worn electronic device of the invention is also not limited to receiving circularly polarized waves, and may be used to receive linearly polarized waves.

The invention can also be used in applications with other RF signals, including Bluetooth® for communication in the 2.4 GHz band, and wireless LAN applications.

The wrist-worn electronic device of the invention is also not limited to wristwatches, and can be used with other types of electronic devices that are worn on the wrist or arm and used to receive, send, or send and receive radio signals.

For example, the invention can be used in cellular telephones that are worn on the wrist and use wireless communication channels; navigation devices that provide guidance from a current location to a destination; information devices that record and display the distance traveled, the time traveled, locations passed, or the elapsed time while running or mountain climbing, for example; and portable information devices with IC card functions enabling use as a commuter pass or entry key, and functions for displaying information such as the usage history of the IC card function.

A dial ring 140 is disposed as a ring member covering the GPS antenna 11 in the foregoing first to third embodiments, but the invention is not so limited. For example, the ring member may be a member without calendar markings, and the inside circumference surface may be perpendicular to the dial 2 rather than sloped or otherwise shaped. Yet further, a ring member is not essential to the invention, and a separate ring member may be omitted if, for example, the inside circumference of the bezel 150 protrudes to the inside so that the GPS antenna 11 is covered and hidden.

Yet further, the GPS antenna 11 may be disposed on the bottom of the dial 2, LCD panel 17, or other display panel (on the side facing the back cover 102), and the GPS antenna 11 may be covered by the information display unit. More specifically, the antenna electrode 112 of the GPS antenna 11 according to the invention may be disposed anywhere along the perimeter of the dial 2, display panel, or other information display unit. Therefore, the antenna electrode 112 may be disposed on the top side of the information display unit as in the first embodiment, the antenna electrode 112 may be disposed on the outside of the information display unit as in the second embodiment, or the antenna electrode 112 may be disposed on the bottom side of the information display unit.

Although the present invention has been described in connection with the preferred embodiments thereof with reference to the accompanying drawings, it is to be noted that various changes and modifications will be apparent to those skilled in the art. Such changes and modifications are to be understood as included within the scope of the present invention as defined by the appended claims, unless they depart therefrom.

What is claimed is:

1. A wrist-worn electronic device, comprising:

an antenna that receives a satellite signal;

a cylindrical case made of a non-conductive material;

an information display unit that is housed inside the cylindrical case and is made, at least in part, of a non-conductive material;

a front piece through which at least a part of the information display unit is visible;

a back cover that is attached to the cylindrical case and is made of a conductive material; and a reception unit that is housed inside the cylindrical case between the information display unit and the back cover, and that processes a reception signal based on the satellite signal received by the antenna;

wherein the antenna has an antenna electrode and a dielectric substrate to which the antenna electrode is disposed;

the back cover is connected to the ground potential of the reception unit and reflects the satellite signal; and the antenna electrode is disposed on a side of the information display unit that is closer to the front piece than to the back cover.

2. The wrist-worn electronic device described in claim 1, wherein:

the back cover is made with a larger outside dimension than the outside dimension of the antenna electrode.

3. The wrist-worn electronic device described in claim 1, further comprising:

a dial ring that is disposed around the outside of the information display unit and is formed in a ring shape from a non-conductive material; and a bezel that is disposed on the outside circumference side of the dial ring and is formed in a ring shape from a non-conductive material;

wherein the antenna is disposed between and covered by the dial ring and the bezel in such a manner that the antenna is not noticeable from outside the wrist-worn electronic device.

4. The wrist-worn electronic device described in claim 1, wherein:

the antenna electrode is formed with a circumferential length approximately equal to one wavelength of the wavelength of the radio signal after wavelength shortening by the dielectric substrate.

5. The wrist-worn electronic device described in claim 1, wherein:

the antenna electrode has an annular main antenna unit disposed to the top of the dielectric substrate on the opposite side as the bottom side thereof facing the back cover, and a power supply unit that branches from at least one junction rendered in part of the main antenna unit and is disposed to the dielectric substrate; and the wrist-worn electronic device also has a connection member that is housed in the case, contacts the power supply unit, and transmits the reception signal to the reception unit.

6. The wrist-worn electronic device described in claim 1, wherein:

the information display unit is a dial or a display panel.

7. The wrist-worn electronic device described in claim 1, wherein:

the relative static permittivity of the dielectric substrate is greater than or equal to 4.

8. A wrist-worn electronic device, comprising:

an antenna that receives a satellite signal;

a cylindrical case, a part of which is made of a conductive material;

an information display unit that is housed inside the cylindrical case and is made, at least in part, of a non-conductive material;

a front piece through which at least a part of the information display unit is visible;

a back cover that is attached to the cylindrical case and is made of a conductive material; and a reception unit that is housed inside the cylindrical case between the information display unit and the back cover, and that processes a reception signal based on the satellite signal received by the antenna; wherein the antenna has an antenna electrode and a dielectric substrate to which the antenna is disposed;

the back cover is connected to the ground potential of the reception unit and reflects the satellite signal;

the conductive part of the cylindrical case and the back cover are not in contact with each other; and the antenna electrode is disposed on a side of the information display unit that is closer to the front piece than to the back cover.

* * * * *